US005165546A

United States Patent [19]

Jaeger et al.

[11] Patent Number: 5,165,546

[45] Date of Patent: Nov. 24, 1992

[54] PHARMACEUTICAL CONTAINER

[75] Inventors: Arthur L. Jaeger, West Chester; James M. Mundt, Lansdale, both of Pa.

[73] Assignee: Merck & Co., Inc., Rahway, N.J.

[21] Appl. No.: 730,337

[22] Filed: Jul. 15, 1991

[51] Int. Cl.[5] ..... B65D 1/04; B65D 83/04

[52] U.S. Cl. ..... 206/534; 206/232; 215/6

[58] Field of Search ..... 215/6, 100 A; 206/534, 206/232

[56] References Cited

U.S. PATENT DOCUMENTS

| | | | |
|---|---|---|---|
| 197,542 | 11/1877 | Carman | 215/6 |
| 378,752 | 2/1888 | Ader | 215/6 |
| 3,256,978 | 6/1966 | Srigley et al. | 206/232 |
| 3,433,378 | 3/1969 | Ross | 215/6 |
| 4,805,789 | 2/1989 | Lancesseur et al. | 215/6 |

FOREIGN PATENT DOCUMENTS

| | | | |
|---|---|---|---|
| 115851 | 12/1900 | Fed. Rep. of Germany | 215/6 |
| 740184 | 11/1932 | France | 215/6 |

*Primary Examiner*—William I. Price
*Attorney, Agent, or Firm*—William H. Nicholson

[57] ABSTRACT

A plastic pharmaceutical container is provided with a removable bottom section defining a cavity adapted to hold the package circular.

9 Claims, 1 Drawing Sheet

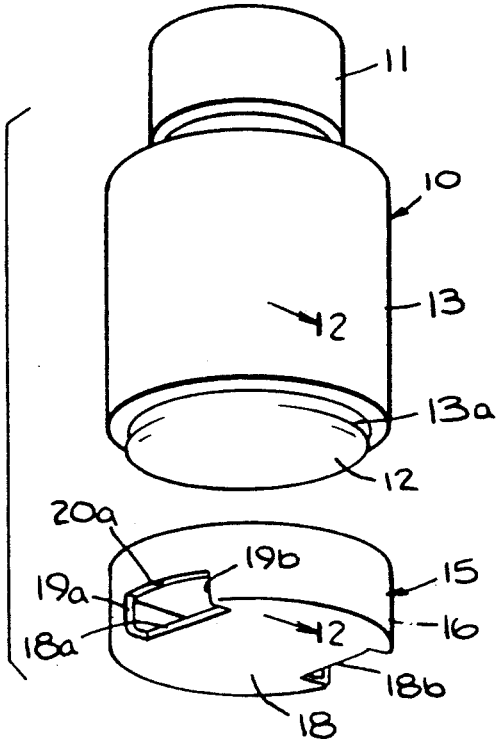
Fig. 1.
Fig. 2.
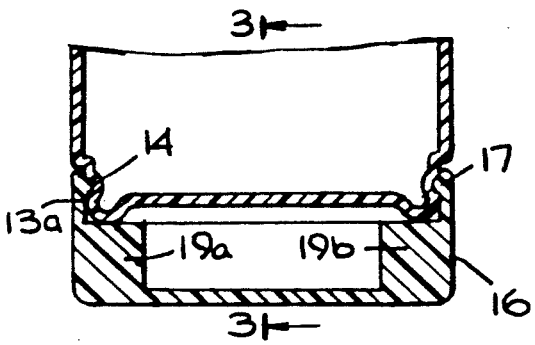
Fig. 3.
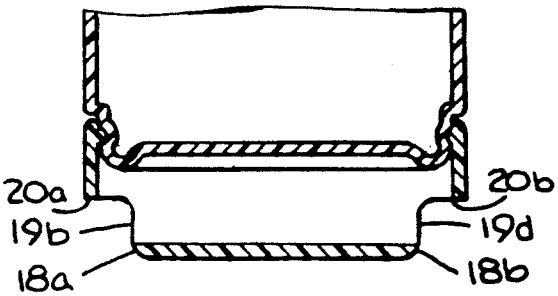
Fig. 4.
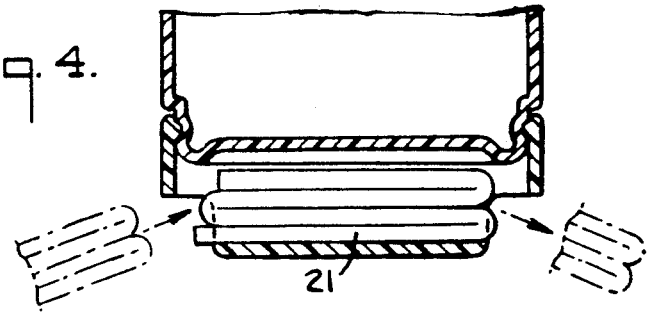
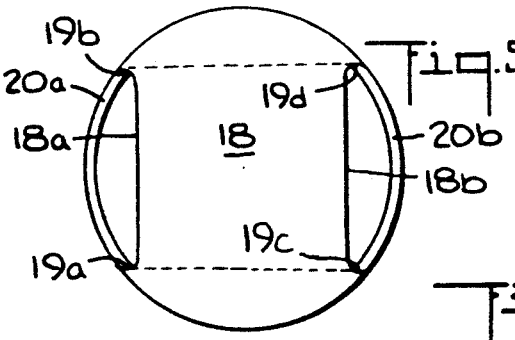
Fig. 5.
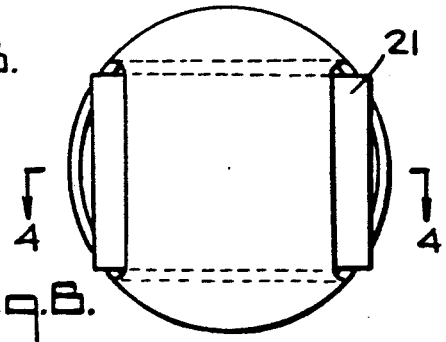
Fig. 8.

PHARMACEUTICAL CONTAINER

BACKGROUND OF THE INVENTION

Printed paperboard cartons are often used to package pharmaceutical containers. Once opened the cartons have to be disposed of, thereby placing a burden on the environment. The containers often provide the package circular (professional or patient literature) in a folded strip that is glued to the cap or side of the bottle. When the package circular is detached for reading, there is no way to reattach it to the container.

OBJECTS OF THE INVENTION

It is, accordingly an object of the present invention to provide a pharmaceutical container that does not require shipment in a paperboard carton. Another object is to provide a pharmaceutical container having hidden means to store the package circular. A further object is to provide a pharmaceutical container adapted to permit removal and reattachment of the package circular. Still another object is to provide a pharmaceutical container having a more attractive appearance. These and other objects of the present invention will be apparent from the following description.

SUMMARY OF THE INVENTION

A plastic pharmaceutical container is provided with a bottom section defining a cavity in which a package circular may be stored out of sight and removed and reattached as often as desired. The bottom ring is adapted to snap onto the bottom of the pharmaceutical container and the bottom of the ring is provided with means adapted to receive and hold a package circular, and to permit its removal and reattachment. This container eliminates the need for a paperboard carton.

BRIEF DESCRIPTION OF THE DRAWINGS

FIG. 1 is a perspective view of one embodiment of a container of the present invention and its bottom section.

FIG. 2 is a cross-sectional view of the bottom section attached to the container.

FIG. 3 is a cross-sectional view of the bottom section attached to the container, rotated 90° with respect to FIG. 2.

FIG. 4 is a cross-sectional view of a package circular being inserted into and removed from the bottom section.

FIG. 5 is a plan view of the bottom section before insertion of the package circular.

FIG. 6 is a bottom plan view of the bottom section after insertion of the package circular.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION

The dispenser device of the present invention preferably is made of a flexible plastic material, for example, low density polyethylene, and can be prepared by any suitable technique, for example, injection molding. It is to be understood that the present invention is not limited to the specific material from which the dispenser device of the present invention is made, or the particular process by which it is made as it will be understood by those skilled in the art that many different materials and various manufacturing techniques may be employed.

The pharmaceutical container of the present invention will now be described with reference to the drawings. The container 10 is preferably formed of a flexible material such as, for example, polyethylene, and is provided with a closure such as, for example, a screw cap 11. The bottom 12 is recessed relative to the container sidewall 13 and has sidewall 13*a* having a smaller diameter than that of sidewall 13.

Bottom section 15 having sidewall 13*b* and bottom flange 16 is designed to fit over the recessed bottom 12 of container 10. The thickness of section 15 preferably is predetermined so that the sidewall of container 10 and that of section 15 form a flush surface. Section 15 is provided with means, e.g., an internal annular flange 17, adapted to cooperate with complementary means in container 10, e.g., groove 14 to hold the section 15 to container 10. Section 15 has an opening defined by chord 18*a* in bottom 18, sides 19*a* and 19*b* extending upwardly from the ends of chord 18*a*, and an arc 20*a* along sidewall 16 joining the upper ends of sides 19*a* and 19*b*. Preferably, a second opening is formed by chord 18*b*, sides 19*c* and 19*d* and arc 20*b*. Preferably, the two chords are parallel. A folded package circular 21 can be fitted into (and removed from) the empty space in section 15 through one of the two openings and can be removed therefrom as shown in FIG. 4 and stored as shown in FIGS. 5 and 6.

While the present invention has been described with reference to a pharmaceutical container, it is to be understood that the present invention is equally applicable to containers for other materials, for example, cosmetic and foodstuff containers.

What is claimed is:

1. A section adapted to attach to the bottom of a container, the section comprising a wall enclosing a space, the wall substantially identical in configuration to that of the bottle to which it is adapted to be fitted, and an opening in the wall of the section to insert and remove an object.

2. A section according to claim 1 wherein the object provides information relating to the contents of the container to which the section is attached or to which it is intended to be attached.

3. A section according to claim 1 having means adapted to attach to the bottom of a pharmaceutical container.

4. A section according to claim 3 wherein the means comprise a member adapted to be received by complementary means on the container.

5. A section according to claim 4 wherein the member comprises an annular flange on the interior surface of the wall adapted to be received in a complementary annular groove on the container.

6. A section according to claim 1 wherein the opening is defined by a chord in the bottom member of the section, sides extending upwardly from the ends of the chord, and an arc along the sidewall joining the upper ends of the sides.

7. A section according to claim 1 having a second opening with a similar function.

8. A section according to claim 7 wherein the second opening is defined by a chord in the bottom member of the section, sides extending upwardly from the ends of the chord, and an arc along the sidewall joining the upper ends of the sides.

9. A section according to claim 8 wherein the chords are substantially parallel.

* * * * *